US005509167A

United States Patent [19]

Wilson

[11] Patent Number: 5,509,167

[45] Date of Patent: Apr. 23, 1996

[54] CLEAT CLEANING TOOL

[76] Inventor: Dylan Wilson, 800 Ambassador, Corsicana, Tex. 75110

[21] Appl. No.: 263,097

[22] Filed: Jun. 21, 1994

[51] Int. Cl.[6] ..... A47L 23/04

[52] U.S. Cl. ..... 15/237; 15/236.06; 15/236.08; 15/236.09; D32/47

[58] Field of Search ..... 15/113, 236.01, 15/236.05, 236.06, 236.08, 236.09, 237; D32/46, 47, 49

[56] References Cited

U.S. PATENT DOCUMENTS

| | | | |
|---|---|---|---|
| D. 247,278 | 2/1978 | Dunn, Jr. | D32/46 |
| D. 293,164 | 12/1987 | Shearer | D32/47 |
| D. 341,453 | 11/1993 | Roma et al. | D32/46 |
| 1,057,090 | 3/1913 | Randall | 15/236.01 |
| 2,524,475 | 10/1950 | Renz | 15/236.08 |
| 2,817,863 | 12/1957 | Johns | D32/47 |
| 2,824,323 | 2/1958 | Tos et al. | 15/236.09 |
| 2,866,218 | 12/1958 | Ranseen | 15/237 |
| 2,980,936 | 4/1961 | Snow et al. | 15/237 |
| 3,045,270 | 7/1962 | Blumlo | 15/237 |
| 3,050,760 | 8/1962 | Darnell | 15/237 |
| 3,111,698 | 11/1963 | Reichle | 15/237 |
| 3,270,363 | 9/1966 | Harris, Jr. | 15/237 |
| 3,955,234 | 5/1976 | Roefaro | 15/236.06 |
| 4,668,302 | 5/1987 | Kolodziej et al. | 15/236.08 |
| 4,670,932 | 6/1987 | Williams | 15/236.08 |

FOREIGN PATENT DOCUMENTS

| | | | |
|---|---|---|---|
| 171454 | 11/1934 | Switzerland | 15/236.05 |

*Primary Examiner*—Mark Spisich

[57] ABSTRACT

A cleat cleaning tool that is comprised of a handle and a first prong and a second prong, the first and second prongs connected to the handle and extending therefrom. The first and second prongs are positioned next to one another to form a groove, which has a groove length and groove width. The groove length is approximately equal to a cleat length and the groove width is approximately equal to a cleat width, so that the groove fits around a cleat, so that the cleat cleaning tool can be moved back and forth around the cleat in order to clean and remove debris (e.g., mud, dirt, and grass) from the cleat. The groove is formed by a first interior surface of the first prong and a second interior surface of the second prong. The first prong has a first end and the second prong has a second end, neither of which is connected to the handle. The first and second prong may be beveled in ordered to provide a fairly sharp edge. Similarly, the first and second ends may be hooked. The hooked ends can be enhanced by indentations of the first and second prong. The first prong has a first width and the second prong has a second width and the handle has a third width. The first width and the second width are preferably not equal to one another, so that the groove is not positioned in the center of the third width.

21 Claims, 3 Drawing Sheets

CLEAT CLEANING TOOL

PARTIAL WAIVER OF COPYRIGHT PURSUANT TO 1077 O.G. 22(3/20/87)

(C) Copyright, Dylan Wilson 1994. All of the material in this patent application is subject to copyright protection under the copyright laws of the United States and of other countries. As of the first effective filing date of the present application, this material is protected as unpublished material.

Portions of the material in the specification and drawings of this patent application are also subject to protection under the maskwork registration laws of the United States and of other countries.

However, permission to copy this material is hereby granted to the extent that the owner of the copyright and maskwork rights has no objection to the facsimile reproduction by anyone of the patent document or patent disclosure, as it appears in the United States Patent and Trademark Office patent file or records, but otherwise reserves all copyright and maskwork rights whatsoever.

BACKGROUND

As most sports fans know, athletes playing sports wear shoes (e.g., baseball, football, soccer, etc.) which often have cleats or unusual patterns on the bottom of their soles for traction purposes. Cleats used vary from sport to sport and from playing condition to playing condition. These cleats often get dirty or muddy and need to be cleaned to improve traction.

This is particularly a problem for baseball cleats that are unusually shaped and positioned in unusual places. For these and other reasons, baseball players usually encounter great difficulty getting the dirt off of their cleats. Baseball players typically use a popsicle stick to remove the dirt and mud from their cleats, which is not very effective mechanism, because popsicle sticks break and do not easily fit around baseball cleats. Similarly, pitchers take "ahh sticks" or tongue depressors out to the mound in an attempt to clean their cleats. "Ahh sticks" or tongue depressors are typically used by doctors to depress a patient's tongue to see the patient's throat. Cleaning cleats with "ahh sticks" does not work very well and generally takes several minutes to do (and essentially stops the baseball game when the pitcher cleans his cleats). In addition, like popsicle sticks, "ahh sticks" often break, which is why a pitchers mound is often littered with broken "ahh sticks." When the "ahh sticks" break, players are forced to use sticks, nails, and rocks, and even their fingers to clean their cleats, especially if there are not any more "ahh sticks" available. If players are forced to use their fingers, they have the additional problem of cleaning their fingers off, which is an important concern for pitchers. Some have even beat their shoes against the wall or ground or together to get dirt and mud off their shoes. None of these existing mechanisms and methods are very effective.

SUMMARY OF THE INVENTIONS

A cleat cleaning tool that is comprised of a handle and a first prong and a second prong, the first and second prongs are connected to the handle and extend therefrom. The first and second prongs are positioned next to one another to form a groove, which has a groove length and groove width. The groove length is approximately equal to a cleat length and the groove width is approximately equal to a cleat width, so that the groove fits around a cleat, so that the cleat cleaning tool can be moved back and forth around the cleat in order to clean and remove debris (e.g., mud, dirt, grass, etc.) from the cleat. The groove is formed by a first interior surface of the first prong and a second interior surface of the second prong. The handle is curved to allow fingers to easily grip the cleat cleaning tool. A grip is positioned on a portion of the handle. Likewise, the handle is large enough to allow a user's hand to easily wrap around the handle. The cleat cleaning tool is comprised of a material, which is preferably selected from the group consisting of wood, metal, and plastic. The first prong has a first end and the second prong has a second end, neither of which is connected to the handle. The first and second may be beveled in ordered to provide a fairly sharp edge. Similarly, the first and second ends may be hooked. The hooked ends can be enhanced by indentations of the first and second prong. The first prong has a first width and the second prong has a second width and the handle has a third width. The first width and second width are not equal to one another, so that the groove is not positioned in the center of the third width.

The disclosed invention has the following advantages. It is effective because the prongs dig into the dirt or mud with ease and also around the cleat or spike to get the cleats perfectly clean. It is also fast. The cleat cleaning tool discussed above is also small enough that you can fit it in your back pocket, so that when the athlete is on the field (e.g., pitching, catching, out in the field, or on base), the player can pull it out and clean their cleats off in a matter of seconds, so that players (e.g., pitchers) can resume playing the game.

BRIEF DESCRIPTION OF THE DRAWINGS

Further features and advantages will become apparent from the following and more particular description of the various embodiments of the invention, as illustrated in the accompanying drawings, wherein.

DETAILED DESCRIPTION OF THE PREFERRED EMBODIMENTS

Figure 1:
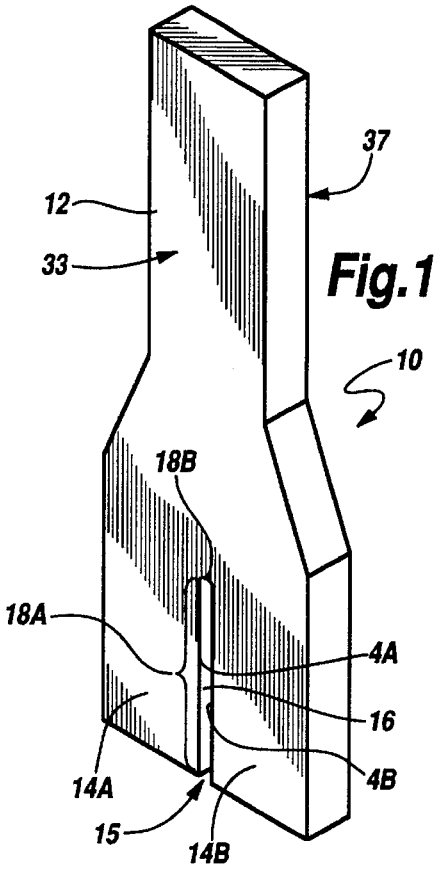
FIG. 1 is a perspective view of a first preferred embodiment of cleat cleaning tool 10.

FIG. 1 is a perspective view of a first preferred embodiment of cleat cleaning tool 10. Cleat cleaning tool 10 is comprised of a handle 12 and first prong 14A and second prong 14B. Prongs 14A and 14B are connected to handle 12 of cleat cleaning tool 10. Prongs 14A and 14B combine to form groove 16, which has length 18A and width 18B. Length 18A and width 18B are long enough and wide enough to fit around a typical cleat, which is not shown in FIG. 1, but is shown in FIG. 3F. Typical cleats (or spikes) cleaned by preferred embodiments are baseball cleats, which usually have a fairly high height (e.g., approximately ⅜" in height), fairly long (e.g., approximately ⅝" in length), and a narrow width (e.g., approximately 1/16" in width). Typical baseball cleats have six spikes, three positioned at angles to one another in the front and three positioned at the back at similar angles to one another (see FIG. 3F). The angles are such that one cleat typically is positioned so that it is in the way when trying to clean a second cleat. Length 18A in preferred embodiments is approximately equal to the height of the cleat, so that prongs 14A and 14B are long enough that they can touch or contact the sole of the shoe and the cleats are attached in order to scrap dirt, mud, grass, and other debris from the sole of the shoe or cleat itself that is positioned next to the base of the cleat which is connected to the sole. Note, however, the length 18A can actually be greater than the height of the cleat. Similarly, width 18B in the first preferred embodiment is approximately equal to the width of the cleat, so that first surface 4A of first prong 14A and second surface 4B of second prong 14B can touch or contact the sole of the shoe and the cleats are attached in order to scrap dirt, mud, grass, and other debris from the external surfaces of a cleat.

Figure 2:
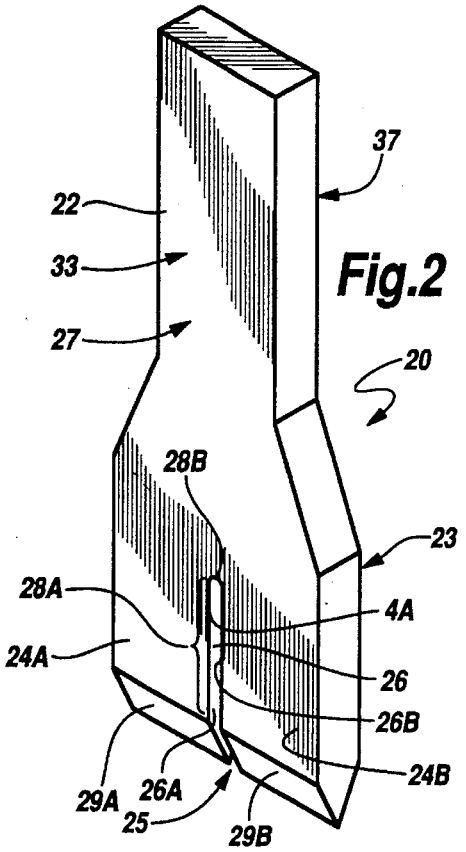
FIG. 2 is a perspective view of a second preferred embodiment of cleat cleaning tool 20.

FIG. 2 is a perspective view of a second preferred embodiment of cleat cleaning tool 20. Like cleat cleaning tool 10 shown in FIG. 1, cleat cleaning tool 20 is comprised of a handle 22 and first prong 24A and second prong 24B. Prongs 24A and 24B are connected to handle 22 of cleat cleaning tool 20. Prongs 24A and 24B combine to form groove 25, which has length 28A and width 28B. Length 28A and width 28B are long enough and wide enough to fit around a typical cleat, which is not shown in FIG. 2, but is shown in FIG. 3F. As in the first preferred embodiment shown in FIG. 1, Length 28A in the second preferred embodiment is approximately equal to the height of the cleat, so that prongs 24A and 24B are long enough that they can touch or contact the sole of the shoe to which the cleats are attached in order to scrap dirt, mud, grass, and other debris from the sole of the shoe or cleat itself that is positioned next to the base of the cleat which is connected to the sole. Note, however, length 28A can actually be greater than the height of the cleat. Similarly, width 28B in the second preferred embodiments is approximately equal to the width of the cleat, so that first surface 26A of first prong 24A and second surface 26B of second prong 24B can touch or contact the sole of the shoe to which the cleats are attached in order to scrap dirt, mud, grass, and other debris from the external surfaces of a cleat. In addition, the ends 29A and 29B of prongs 24A and 24B, respectively, that are not connected to handle 22 which are beveled from at least one sides 23 and 27 (which identify opposite sides of cleat cleaning tool 20) to create a pointed end or edge to enable the user to dig into and scape off the dirt, mud, etc.

Figure 3A:
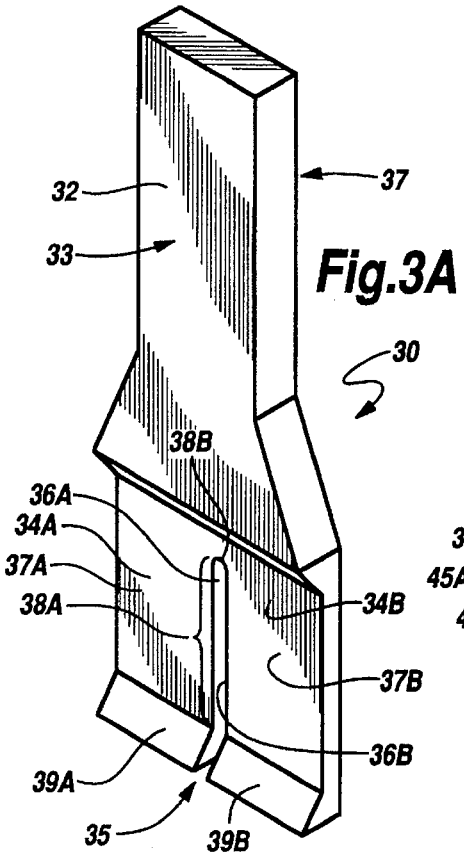
FIG. 3A a perspective view of a third preferred embodiment of cleat cleaning tool 30.
Figure 3B:
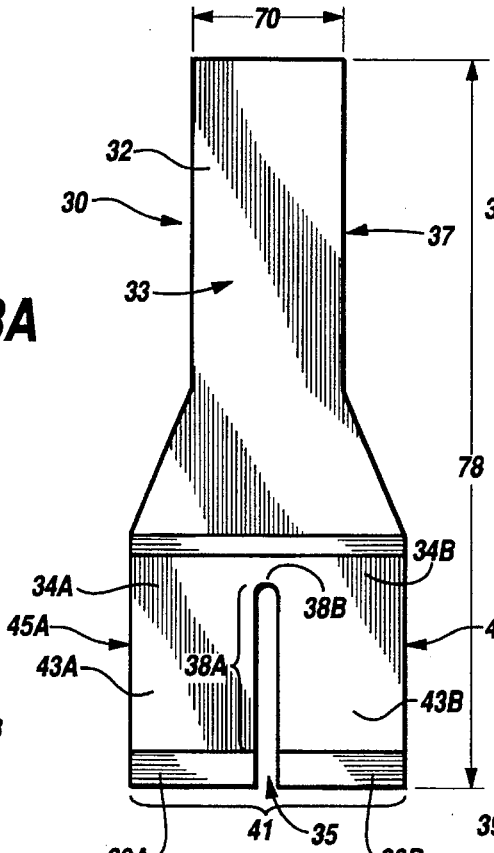
FIG. 3B is another perspective view of the third preferred embodiment of cleat cleaning tool 30.
Figure 3C:
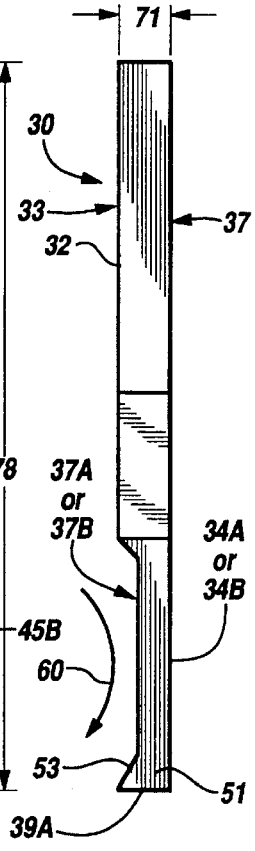
FIG. 3C is another perspective view of the third preferred embodiment of cleat cleaning tool 30.
Figure 3D:
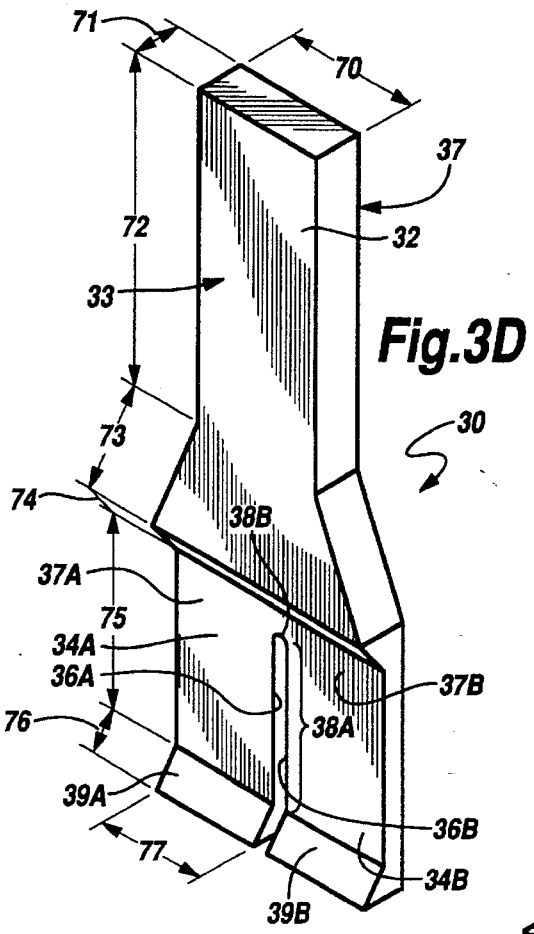
FIG. 3D is another perspective view of the third preferred embodiment of cleat cleaning tool 30.
Figure 3E:
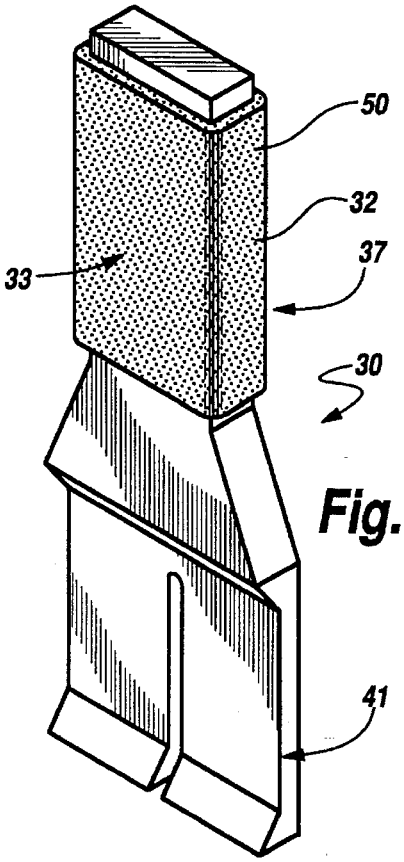
FIG. 3E is another perspective view of the third preferred embodiment of cleat cleaning tool 30.
Figure 3F:
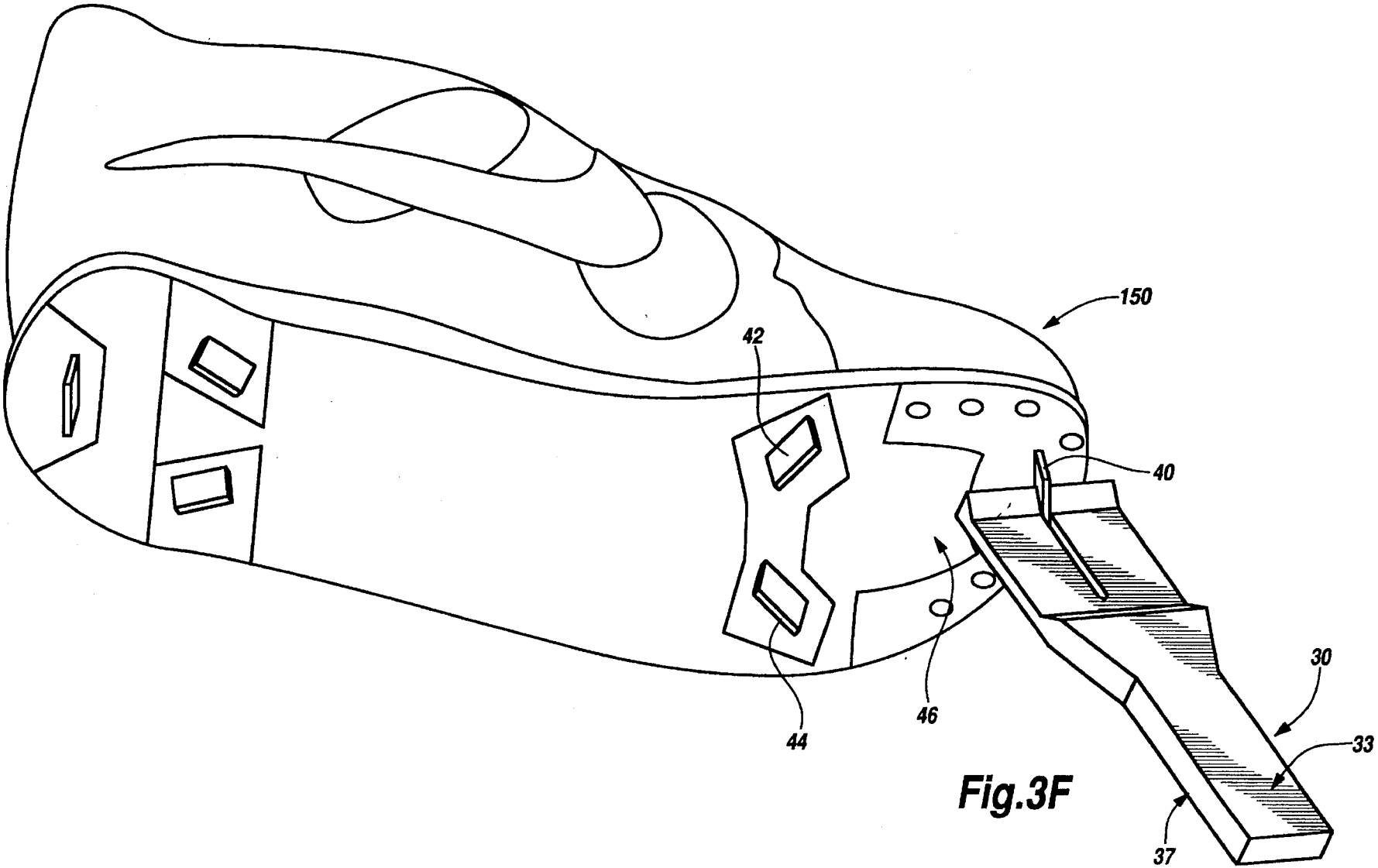
FIG. 3F is another perspective view of the third preferred embodiment of cleat cleaning tool 30 being used to clean a cleat 40 on shoe 50.

FIGS. 3A–3E are perspective views of a third preferred embodiment of cleat cleaning tool 30. Like cleat cleaning tool 10 shown in FIG. 1 and cleat cleaning tool 20 shown in FIG. 2, cleat cleaning tool 30 is comprised of a handle 32 and first prong 34A and second prong 34B. Prongs 34A and 34B are connected to handle 32 of cleat cleaning tool 30. Prongs 34A and 34B combine to form groove 35, which has length 38A and width 38B. Referring to FIGS. 3B, 3C, and 3D, length 38A is preferably equal to ⅞ inches long and width 38B is preferably equal to 1 1/16 inches wide. Other relevant dimensions are shown in FIGS. 3B, 3C, and 3D include distance 70, distance 71, distance 72, distance 73, distance 74, distance 75, distance 76 distance 77, distance 78, wherein distance 70 is preferably ¾ inches; distance 71 is preferably ⅜ inches, distance 72 is preferably 1¾ inches; distance 73 is preferably 1⅞ inches; distance 74 is preferably ¼ inches; distance 75 is 1⅛ inches; distance 76 is preferably ¼ inches; distance 77 is preferably 1 1/16 inches; distance 78 is preferably 4 inches; and length 41 is preferably 1 ½ ". Length 38A and width 38B are long enough and wide enough to fit around a typical cleat, which is shown in FIG. 3F. FIG. 3F is another perspective view of the third preferred embodiment of cleat cleaning tool 30 being used to clean a cleat 40 on shoe 50, which shows the unusual placement of cleat 40 in conjunction with cleats 42 and 44 on the sole 46 of baseball shoe 50.

As in the first and second preferred embodiments shown in FIGS. 1 and 2, length 28A in the second preferred embodiment is approximately equal to the height of the cleats 40, 42, and 44 of FIG. 3F, so that prongs 34A and 34B are long enough that they can touch or contact the sole of the shoe to which the cleats are attached in order to scrap dirt, mud, grass, and other debris from the sole of the shoe or cleat itself that is positioned next to the base of the cleat which is connected to the sole. Note, however, length 38A can actually be greater than the height of the cleat. Similarly, width 38B in the third preferred embodiments is approximately equal to the width of the cleat, so that first surface 36A of first prong 34A and second surface 36B of second prong 34B can touch or contact the sole of the shoe to which the cleats are attached in order to scrap dirt, mud, grass, and other debris from the external surfaces of a cleat. In addition, the ends of prongs 34A and 34B (in FIGS. 3A, 3B, and 3D) are not connected to handle 32 which are beveled from at least one sides 33 and 37 (which identify opposite sides of cleat cleaning tool 30) to create a pointed end(s) 39A and 39B to easily enable the user to dig into and scape off the dirt, mud, etc. Similar to the beveled ends 29A and 29B of cleat cleaning tool 20 in FIG. 2, first and second ends of prongs 34A and 34B are angled to create a pointed end 51 (on at least one prong 34A and 34B) and also a second pointed end 53 to enable the user to dig into and scape off the dirt, mud, etc., as shown in FIG. 3C. Please note that by pointed, preferred system embodiments have a consistent edge to scrap off dirt or mud, not a sharp pointed edge like a pencil. While a sharp edge is possible, it would have the disadvantages of pricking a player carrying it in his pocket. Moreover, as shown in FIGS. 3C–3D, prongs 34A and 34B have indentations 37A and 37B that further enhance the hook positioned on prongs 34A and 34B. In general, the greater the angle of the hook 60, the easier it is for the user to clean the cleats. Note, however, the depth and angle of the indentation and hook created at ends of prongs 34A and 34B should not be deep or fragile, so that the tool will break while being used.

Figure 4:
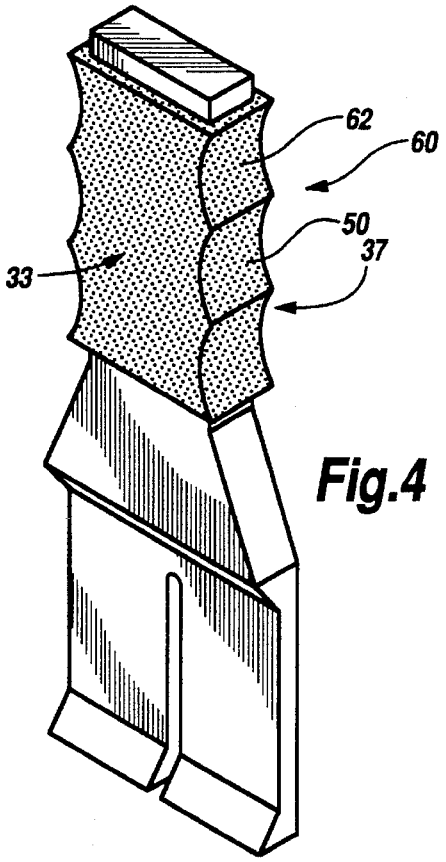
FIG. 4 is another perspective view of a fourth preferred embodiment of cleat cleaning tool 60.

Note that the actual dimensions shown in FIGS. 3B–3D are illustrative in nature and except for the relationships between the dimensions of the cleats and the tools discussed above, dimensions can be altered. For instance, the overall length of handle 32 is preferably longer to enable a larger hand to fit around the handle. In addition, as shown in FIG. 4, which shows another perspective view of a fourth preferred embodiment of cleat cleaning tool 60, handle 62 could be curved to provide indentations for fingers to hold handle 62. A gripping mechanism 50 could be slipped or fitted over handle 62 to provide an easily gripping action (e.g., comprised of rubber, etc.). Similarly, width 41 could also be shortened in order to fit in any small crevace or indentation on the bottom of shoe 150. While groove 35 is positioned between first prong 34A and second prong 34B and prongs 34A and 34B are approximately the same size, then groove 35 is approximately in the middle of cleat cleaning tool 30, like prongs 24A and 24B and groove 25 in cleat cleaning tool 20 of FIG. 2 and prongs 14A and 14B and groove 15 of cleat cleaning tool 10 of FIG. 1. Prongs 34A and 34B do not have to be the same size in terms of actual length 43A and width 43B (in FIG. 3B). In fact, prongs 34A and 34B do not have to have equal length 43A and width 43B, so that groove 35 is actually closer to a first side 45B (e.g., the right) or a second side 45A (e.g., the left), depending upon whether the user was right or left handed.

The third preferred embodiment, labeled as cleat cleaning tool 30, removes dirt easier than the first and second preferred embodiments. It generally requires very little effort and is quick.

All of the preferred embodiments can be comprised of several materials. For instance, cleat cleaning tools 10, 20, and 30 can be comprised entirely or partially of wood (e.g., white pine) or plastic (e.g., poly-acrylic plastic). Plastic has the added advantage that it can be easily molded. Metal could also be used.

FURTHER MODIFICATIONS AND VARIATIONS

Although the invention has been described with reference to a specific embodiment, this description is not meant to be construed in a limiting sense. As described above, various modifications of the disclosed embodiment as well as alternate embodiments of the invention will become apparent to persons skilled in the art upon reference to the description of the invention. Accordingly, it should be understood that the modifications and variations suggested above are not intended to be exhaustive.

What is claimed is:

1. A tool for cleaning a cleat extending from a sole of a shoe, said tool comprising:

(a) an elongated handle having a handle end; and (b) a first elongated prong and a second elongated prong, each of said first elongated prong and of said second elongated prong having a first prong end and a free prong end, said free prong end and said first prong end of each of said first elongated prong and of said second elongated prong positioned opposite of one another, each said first prong ends connected to and extending from said handle end of said elongated handle, said first elongated prong and said second elongated prong substantially straight and substantially parallel to one another and defining therebetween an elongated groove having an open end and a closed end, said open end and said closed end opposite from one another, said open end of said elongated groove adjacent to said free prong ends of said first elongated prong and of said second elongated prong, said closed end spaced from said open end, said elongated groove also formed by a first side portion of said first elongated prong and a second side portion of said second elongated prong, said first side portion and said second side portion extending from said open end to said closed end, said elongated groove also having a substantially constant width between said first side portion and said second side portion from said open end of said elongated groove to said closed end of said elongated groove, said free ends of each of said first elongated prong and of said second elongated prong having a front face and a back face, said front face and said back face of each of said first elongated prong and of said second elongated prong having beveled surfaces which cooperate to define a pointed edge at said free end of each of said first elongated prong and of said second elongated prong; and (c) whereby said elongated groove is adapted to receive said cleat and to scrape off any debris located thereon as well as said sole adjacent to said cleat.

2. The tool of claim 1, wherein said elongated handle has a plurality of curved indentations, said plurality of curved indentations allow a user's fingers to easily grip said tool.

3. The tool of claim 1, wherein a grip covers a portion of said elongated handle.

4. The tool of claim 1, wherein said tool is comprised of a material, said material selected from the group consisting of wood, metal, and plastic.

5. The tool of claim 1, wherein said groove is large enough so that said tool can be moved back and forth longitudinally along said cleat to remove said debris attached to said cleat and positioned on said sole around said cleat.

6. The tool of claim 1, wherein said elongated handle is large enough to allow a user's hand to easily wrap around said elongated handle.

7. The tool of claim 1, wherein said first elongated prong has a first width and said second elongated prong has a second width and said elongated handle has a third width, said third width having a center, said first width and said second width are not equal to one another, so that said elongated groove is not positioned in the center of said third width.

8. The tool of claim 1, wherein said elongated handle, said first elongated prong and said second elongated prong are small enough to enable said tool to entirely fit in a pants pocket.

9. The tool of claim 1, wherein said first side portion and said second side portion are substantially planar and parallel to one another.

10. The tool of claim 1, wherein said groove is rectangular whereby the tool is adapted to conform to the shape of a cleat of a baseball shoe.

11. A cleat cleaning apparatus for cleaning a cleat extending from a sole of a shoe, said apparatus comprising:

(a) an elongated handle having a first handle end; and (b) a first elongated prong and a second elongated prong, each of said first elongated prong and of said second elongated prong having a first prong end and an opposite free prong end, each of said first prong ends connected to and extending from said first handle end of said elongated handle, each of said first elongated prong and of said second elongated prong having a longitudinal axis, said first elongated prong and said second elongated prong substantially straight and substantially parallel to one another and defining therebetween an elongated groove having an open end and a closed end, said open end and said closed end opposite from one another, said open end of said elongated groove adjacent to said free prong end of said first elongated prong and to said free prong end of said second elongated prong, said closed end spaced from said open end, said elongated groove also formed by a first side portion of said first elongated prong and a second side portion of said second elongated prong, said first side portion and said second side portion extending from said open end to said closed end, said elongated groove also having a substantially constant width between said first side portion and said second side portion from said open end to said closed end of said elongated groove, said free ends of each of said first elongated prong and of said second elongated prong having a respective end surface oriented substantially perpendicular to said respective longitudinal axis of said first elongated prong and of said second elongated prong, said free ends of each of said first elongated prong and of said second elongated prong also having a second surface defining an acute angle with the respective end surface, wherein said end surfaces and said second surfaces each respectively define a pointed end which extend laterally outward relative to said longitudinal axis of the respective one of said first elongated prong and said second elongated prong; and (c) whereby said elongated groove is adapted to receive said cleat and to scrape off any debris located thereon as well as said sole adjacent to said cleat.

12. The apparatus of claim 11, wherein said first elongated prong is curved to form a first hook and said second elongated prong is curved to form a second hook.

13. The apparatus of claim 11, wherein said first elongated prong has a first hooked end and said second elongated prong has a second hooked end, said first hooked end and said second hooked end curved in a direction at an angle approximately perpendicular to said elongated handle.

14. The cleat cleaning apparatus of claim 11, wherein said elongated handle has a plurality of curved indentations, said plurality of curved indentations allow a user's fingers to easily grip said cleat cleaning apparatus, further wherein a grip covers a portion of said elongated handle.

15. The cleat cleaning apparatus of claim 11, wherein said cleat cleaning apparatus is comprised of a material, said material selected from the group consisting of wood, metal, and plastic.

16. The cleat cleaning apparatus of claim 11, wherein said elongated groove is large enough so that said cleat cleaning apparatus can be moved back and forth longitudinally along said cleat to remove said debris attached to said cleat and positioned on said sole around said cleat.

17. The cleat cleaning apparatus of claim 11, wherein the pointed end of each of said free prong ends of said first elongated prong and said second elongated prong includes a beveled surface.

18. The cleat cleaning apparatus of claim 11, wherein said first side portion and said second side portion are substantially planar and parallel to one another and further wherein said end surfaces are substantially planar.

19. The cleat cleaning apparatus of claim 11, wherein said elongated handle, said first elongated prong and said second elongated prong are small enough to enable said apparatus to entirely fit in a pants pocket.

20. The cleat cleaning apparatus of claim 11, wherein said first elongated prong has a first recessed region positioned within said first elongated prong between said first prong end of said first elongated prong and said free prong end of said first elongated prong and said second elongated prong has a second recessed region positioned within said second elongated prong between said first prong end of said second elongated prong and said free prong end of said second elongated prong.

21. The cleat cleaning apparatus of claim 11, wherein said groove is rectangular whereby the apparatus is adapted to conform to the shape of a cleat of a baseball shoe.

* * * * *